US005103756A

United States Patent [19]

Korkames

[11] Patent Number: 5,103,756

[45] Date of Patent: Apr. 14, 1992

[54] MAGNETIC PLACEMARK

[75] Inventor: Thomas Korkames, Bristow, Okla.

[73] Assignee: Judy J. Walsh, Norwood, Mass.

[21] Appl. No.: 647,435

[22] Filed: Jan. 29, 1991

[51] Int. Cl.[5] ..... B42D 9/00

[52] U.S. Cl. ..... 116/234; 116/240

[58] Field of Search ..... 116/234, 240; 40/600, 40/641, 359; 24/303; 281/42

[56] References Cited

U.S. PATENT DOCUMENTS

| | | | |
|---|---|---|---|
| 2,448,611 | 9/1948 | Martin | 116/234 |
| 3,670,691 | 4/1970 | Anderson | 116/237 |
| 3,697,100 | 10/1970 | Hawkins | 281/42 |
| 4,255,837 | 3/1981 | Holtz | 24/303 |
| 4,505,219 | 12/1983 | Mangano | 116/234 |
| 4,848,799 | 5/1988 | Turetsky | 281/42 |

*Primary Examiner*—William A. Cuchlinski, Jr.
*Assistant Examiner*—W. Morris Worth
*Attorney, Agent, or Firm*—Allegretti & Witcoff, Ltd.

[57] ABSTRACT

A placemark has mutually magnetically attractive surfaces disposed opposite one another. The magnetic surfaces are connected to each other by a flexible connecting web, such that they can be separated from each other and closed again on opposite sides of a sheet, for example a page of a book. The placemark is held in position on the sheet by the force of the magnetic attraction between the magnetic surfaces. Thus, the magnetic surfaces grip the periphery of the sheet between them. The placemark further comprises preferably a marker web which extends from the connecting web.

8 Claims, 1 Drawing Sheet

MAGNETIC PLACEMARK

INTRODUCTION

This invention relates to a placemark, and more particularly, to a placemark which employs magnetic means to hold a position at the periphery of a sheet.

BACKGROUND

Placemarks are known which employ various means for attachment to a sheet. The simplest placemarks include relatively thin, usually flexible strips which can be placed between the pages of a book. Such marks, however, can slip from the book, losing the location of the page. Other placemarks are known which employ a split piece of flexible metal, plastic, etc. and operate much like a paper clip. Bookmarks of this type are generally effective, but depend upon the continued integrity and flexibility of the metal or plastic material at the point where it splits. In addition, placemarks of this type rely upon compression which can cause an undesirable marking or indentation of the sheet.

It is an object of the present invention to provide a new placemark. In particular, it is an object of certain preferred embodiments of the invention to provide a placemark useful as a bookmark to mark one or more pages in a book. Additional objects and advantages of the invention will be understood in view of the present disclosure.

SUMMARY OF THE INVENTION

The placemark of the present invention comprises magnetic means having first and second, mutually magnetically attractive surfaces which can be magnetically fixed to each other on opposite sides of a page in a book or other sheet. The magnetic surfaces are attached to one another by a flexible connection web. The flexible connection web allows the two magnetic surfaces to be spread apart and then closed toward each other on opposite sides of a sheet. The placemark preferably further comprises a marker web extending from the magnetic means. The size and shape of the marker web can be selected for the particular application intended for the placemark.

Several advantages are provided by various embodiments of the present invention. The strength of the magnetic forces of the magnetic means can be selected to meet the particular intended application. Thus, for example, for use as a bookmark the magnetic interattraction between the magnetic faces need be sufficient only to hold the magnets in position facing each other on opposite sides of a single page of a book. In those embodiments wherein the magnetically interattractive surfaces are substantially flat, their contact with a sheet will cause little or no marking or indentation of the sheet, such as would be caused by a paperclip-type bookmark. These and additional features and advantages of the present invention will be better understood from the following description of certain preferred embodiments of the invention.

BRIEF DESCRIPTION OF THE DRAWINGS

The following detailed description of certain preferred embodiments of the invention will include discussion of the appended drawings in which.

DETAILED DESCRIPTION OF PREFERRED EMBODIMENTS

Figure 1:
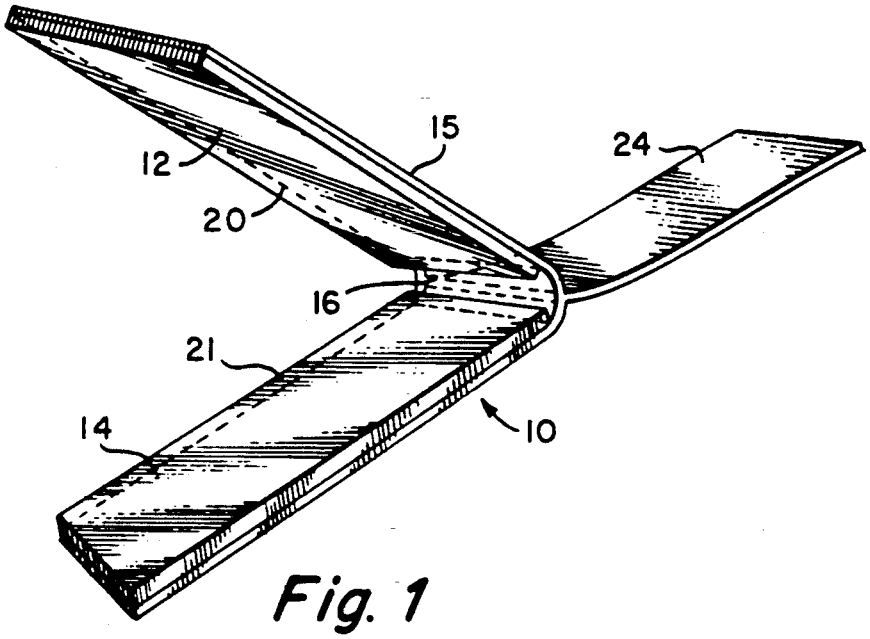
FIG. 1 is a perspective view of a placemark in accordance with a preferred embodiment of the invention, shown in the open position.
Figure 2:
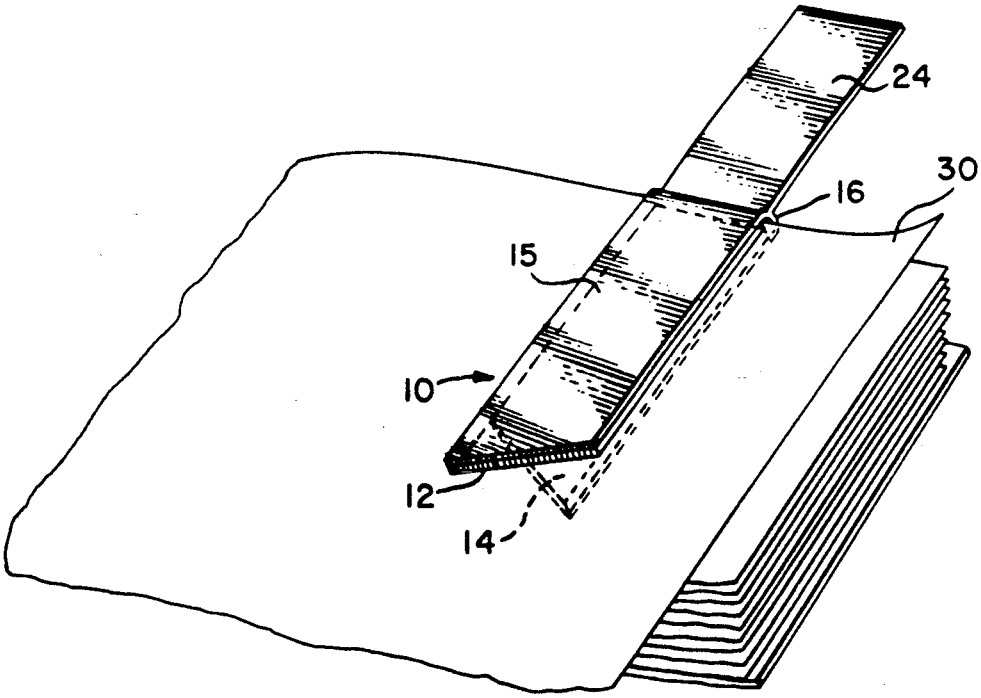
FIG. 2 is a perspective view of the placemark of FIG. shown in the closed position affixed to the periphery of a sheet of paper, specifically a page in a book.

Referring now to FIGS. 1 and 2, a placemark 10 is seen to comprise relatively thin, rectilinear magnetic bodies 12 and 14. The two magnetic bodies 12 and 14 are adhesively bonded at spaced locations along a narrow flexible web 15. The gap 16 between the two magnetic bodies on web 15 should be sufficient to allow the magnetic bodies to move relative one another, to be positioned opposite each other on opposite sides of a desired number and thickness of sheets. Magnetic bodies 12 and 14 are seen to be generally rectilinear and to have flat surfaces 20 and 21 respectively. Surfaces 20 and 21 are mutually magnetically attractive and face each other in the closed position illustrated in FIG. 2. It can be seen that the bottom of the magnetic bodies, that is, the edge of each which is furthest from the gap 16, are oppositely beveled. This facilitates separating the magnetic bodies from each other when they are in the closed position, especially when in the closed position without a sheet between them.

According to a preferred embodiment, the magnetic bodies 12 and 14 are somewhat flexible. Such magnetic bodies are commercially available and relatively inexpensive. In fact, they are available with adhesive preapplied to one surface. This simplifies the manufacture of the placemark, since the magnetic bodies need merely be pressed into position in the connecting web. The connecting web preferably is a fabric strip, such as a ribbon or the like. According to an alternative embodiment, however, the two magnetic surfaces 20 and 21 may simply be separate surface areas of a single unitary magnetic body sufficiently flexible to close upon itself.

In the preferred embodiment illustrated in FIGS. 1 and 2, the placemark further comprises a marker web 24. It will be appreciated in view of the present disclosure that the connecting web and magnetic means alone would be a sufficient marker for many applications. The marker web, however, offers several advantageous uses. Preferably, for example, it is an elongate fabric strip, such as ribbon or the like. The ribbon can be merely decorative or may carry information, such as commercial advertising, a corporate logo, a political message, etc. The marker web may simply be a unitary extension of the connecting web. Alternatively, the marker web is separate and is attached, for example adhesively attached, to the connecting web or any other portion of the magnetic means. The marker web may extend from any location on the magnetic means but, preferably, is not attached to either magnetic surface 20 or 21, since this could interfere with the magnetic attraction between them.

Referring specifically to FIG. 2, it can be seen that the placemark is in a magnetically closed position. That is, the magnetic surfaces 20 and 21 are sufficiently proximate one another to magnetically hold themselves in a fixed position on opposite sides of a sheet in such closed position. More specifically, the placemark is seen in FIG. 2 to be fixed at the periphery of a page or sheet 30 of a book. The magnetic surfaces 20 and 21 face each other and are directly opposite each other on opposite sides of sheet 30. The magnetic interattraction between the magnetic faces holds the placemark in position. The marker web 24 is seen to extend away from the magnetic means.

While various exemplary and preferred embodiments of the invention have been illustrated and described above, it will be apparent to those skilled in the art, in light of this disclosure, that variations and modifications can be made without departing from the true spirit of the invention. All such variations and modifications are intended to be included within the scope of the appended claims.

I claim:

1. A placemark comprising magnetic means for holding a position on a sheet and a flexible marker web, the magnetic means having first and second mutually magnetically attractive surface areas interconnected to each other by a flexible connecting web and moveable relative to each other into, and out of, magnetically closed position facing each other, the flexible marker web extending from said connecting web, wherein said magnetic means comprises a pair of magnetic bodies spaced from each other on said flexible connecting web.

2. The placemark of claim 1 wherein each of said magnetic bodies is a generally rectilinear, flexible magnetic body.

3. The placemark of claim 1 wherein said marker web is an elongate ribbon.

4. The placemark of claim 1 wherein said magnetic bodies are adhesively attached at spaced locations on said flexible connecting web.

5. A placemark comprising magnetic position holding means for securing the placemark to a peripheral position on a sheet and a flexible marker web, the position holding means comprising first and second thin flexible magnets each having a first flat surface adhesively bonded at spaced locations on a flexible connecting web and a second flat surface opposite the first flat surface, the magnets being moveable toward each other sufficiently to place the second flat surface of each of the two magnets in magnetically closed position with each other on opposite sides of a sheet, the flexible marker web extending from the flexible connecting web.

6. A placemark comprising magnetic means for holding a position on a sheet, the magnetic means having first and second mutually magnetically attractive surface areas interconnected to each other by a flexible connecting web and moveable relative to each other into, and out of, magnetically closed position facing each other, a distal end of said first and second mutually magnetically attractive surface areas being oppositely beveled relative each other.

7. The placemark of claim 6 further comprising an elongate flexible marker web extending from the flexible connecting web.

8. A placemark comprising magnetic position holding means for securing the placemark to a peripheral position on a sheet and an elongate flexible marker web, the position holding means comprising first and second thin flexible magnets each having a first flat surface adhesively bonded at spaced locations on a flexible connecting web and a second flat surface opposite the first flat surface, the magnets being movable toward each other sufficiently to place the second flat surface of each of the two magnets in magnetically closed position with each other on opposite sides of a sheet, the magnets being oppositely beveled and the elongate flexible marker web extending from said connecting web.

* * * * *

UNITED STATES PATENT AND TRADEMARK OFFICE

CERTIFICATE OF CORRECTION

PATENT NO. : 5,103,756

DATED : April 14, 1992

INVENTOR(S) : Thomas Korkames et al

It is certified that error appears in the above-identified patent and that said Letters Patent is hereby corrected as shown below:

On Title page

The inventorship and assignee are amended to read as follows:

[75] Inventors: Thomas Korkames, Bristow, Okla;
Judy J. Walsh, Walpole, Mass.

[73] Assignee: Judy J. Walsh, Walpole, Mass.

Signed and Sealed this

Sixteenth Day of February, 1993

*Attest:*

STEPHEN G. KUNIN

*Attesting Officer*

*Acting Commissioner of Patents and Trademarks*